United States Patent [19]

Tehan

[11] Patent Number: 4,795,165

[45] Date of Patent: Jan. 3, 1989

[54] FOLDING ARROW

[76] Inventor: Frank V. Tehan, 1801 Eastshore Hwy., Berkeley, Calif. 94710

[21] Appl. No.: 832,741

[22] Filed: Feb. 24, 1986

[51] Int. Cl.[4] ..... F41B 5/02

[52] U.S. Cl. ..... 273/416; 403/109

[58] Field of Search ..... 273/416, 419–423; 403/101, 102, 291, 109, 166; 135/110, 100, 74

[56] References Cited

U.S. PATENT DOCUMENTS

| | | | |
|---|---|---|---|
| 3,223,098 | 12/1965 | Dole, Jr. | 135/104 |
| 3,448,748 | 6/1969 | Walrave | 135/104 |
| 3,669,133 | 6/1972 | Hyman | 135/74 U X |
| 3,730,544 | 5/1973 | Hyman | 135/114 X |
| 3,759,519 | 9/1973 | Palma | 273/416 |
| 3,947,141 | 3/1976 | Casset | 403/166 X |
| 3,963,037 | 6/1976 | Clark | 403/109 X |
| 4,050,696 | 9/1977 | Troncoso, Jr. | 273/420 |
| 4,141,554 | 2/1979 | Sherwin | 273/420 |
| 4,236,543 | 12/1980 | Moss | 135/104 X |

FOREIGN PATENT DOCUMENTS

| | | | |
|---|---|---|---|
| 972971 | 2/1951 | France | 135/114 |
| 1300282 | 6/1962 | France | 135/114 |
| 11012 | of 1911 | United Kingdom | 135/114 |

OTHER PUBLICATIONS

Archer's Bible 1966–67, 3–1967, pp. 54, 55, 53, 74.
Archery, 4–1978, p. 14, Snuggers.
Archery, 11–1978, Easton "Klicka-Point".

*Primary Examiner*—Paul E. Shapiro

[57] ABSTRACT

An archery arrow which can be compacted to a smaller size by folding and which can be opened to full size rapidly and easily. The arrow consists of a tubular shaft of two sections: A female front section and male rear section. The male rear section has a tubular insert extending from its front end which telescopically mates with the rear end of the female front section. An internal elastic cord connects both front and rear sections, and allows the shaft sections to be separated and folded, and to be quickly "snapped" together and joined into an extended, ready position for shooting in a bow. The folding arrow incorporates a standard tip, nock and fletches or vanes.

6 Claims, 1 Drawing Sheet

FOLDING ARROW

BACKGROUND

1. Field of Invention

This invention relates to archery, particularly to an improved arrow which can be compacted to a smaller size and opened to full size rapidly and easily.

2. Discussion of Prior Art

Arrows have been known for millenia. The history of their development has been in the direction of arrows that shoot farther, faster, and with greater accuracy. Modern arrow technology has tried to advance these performance goals by the following expedients:

(1) LOWER WEIGHT. By lowering their weight, arrows can be made to shoot faster and travel farther. The use of modern aluminum alloys and glass/resin combinations has allowed arrow makers to produce small diameter, tubular shafts that are lightweight, but are still quite stiff and strong.

(2) SMALLER DIAMETER. An arrow shaft with a smaller, more uniform diameter is lighter and more aerodynamic, and is, therefore, faster and has a greater range, than an arrow shaft with a larger, less uniform diameter. It is more aerodynamic because it has a smaller cross-section and less surface area.

(3) INCREASED STIFFNESS OR "SPINE". The spine of an arrow shaft is defined by Easton Aluminum as the measured deflection, in inches, of a shaft of a given length when depressed by a 879.7 gram weight at its center. It is very desirable that an arrow have a stiff spine because upon release of the bowstring, the force of the string acting upon the inertia of the arrow causes it to flex or deflect. If this deflection is excessive, the arrow will "fishtail", causing loss of both speed and accuracy. Unfortunately, increased spine is usually attained by increasing the arrow's diameter, but increasing the diameter results in a heavier, less aerodynamic and, consequently, slower arrow. Therefore, modern arrows use tubular shafts of high strength aluminum alloys or glass/resin combinations to maximize spine for the smallest practicable diameter, wall thickness, and weight.

(4) STRAIGHTNESS. This is an extremely important attribute of an arrow and results in greater accuracy. Modern arrow shaft producers use very sophisticated technology to insure maximum straightness or "trueness".

(5) CORRECT BALANCE POINT. The balance point of the arrow is a very important contributing factor to its proper flight and accuracy. According to Easton Aluminum, balance point for a target arrow is from 7% to 9% of the shaft's length, measured in front of the center point (F.O.C.) of the arrow's shaft. In a bow hunting arrow, the balance point can be slightly forward of the 7% to 9% F.O.C.

The above performance goals of a modern arrow have been attained at some difficulty, through the use of sophisticated engineering, modern materials, and accumulated experience of many generations.

I have found that another desirable feature is compactibility. If an arrow could be made compactible, an archer could store, carry, and handle arrows in ways that are not possible with traditional, one-piece arrows. This is because most arrows are about 24" to 34" long and thus are quite awkward to handle, store, and carry when target shooting, hunting, etc., as well as when travelling to these activities. Because the emphasis in modern arrow technology has been on increased spine and straightness with smaller diameter shafts, little experimentation, research, or consideration has been given to compactibility. It was assumed by those knowledgable in the field that an articulated arrow shaft would have too much wobble (lack straightness or "trueness") to have the accuracy required of the best modern archery arrows.

A previous attempt to create a compactible arrow is shown in U.S. Pat. No. 3,759,519 to Palma, Sept. 8, 1973. This arrow has a front shaft section which telescopes into a rear shaft section. Palma's telescoping arrow is inferior to conventional, one-piece arrows for the following reasons:

(1) Palma's telescoping arrow is constructed of two shaft sections, with a smaller diameter shaft section in the front end that abruptly changes to a larger diameter shaft section in the rear end. The conventional arrow has a uniform diameter throughout its entire length, which is the shape that has proven itself through millenia of use to be ideal.

(2) All modern bows use some sort of arrow rest. The arrow rides along this rest as it is being propelled forward by the bowstring. Any abrupt change in the diameter of the shaft will deflect the arrow far off the intended course. The abrupt change in the diameter of the shaft of Palma's arrow makes it practically impossible to use his arrow with bows having an arrow rest.

(3) Palma's telescoping arrow is much heavier than a conventional arrow due to its larger rear shaft section and its numerous parts.

(4) The balance point of Palma's telescoping arrow is in the rear half of the arrow, whereas the balance point of the conventional arrow is in the front half.

(5) The spine of Palms's telescoping arrow is not uniform because its front and rear shaft sections have different diameters. The conventional arrow has a uniform spine because its shaft has a uniform diameter.

(6) There will be wobble between the front and rear shaft sections of Palma's telescoping arrow because of the manner in which the front shaft section is supported by the rear shaft section. This potential wobble will have an adverse effect on the straightness or "trueness" of this telescoping arrow. A conventional arrow can not have this type of wobble because the shaft is in one piece.

The above comparison shows that Palma's telescoping arrow is far inferior to a conventional, one-piece arrow. Most archers, and in particular bow hunters, would find it very useful to have a compactible arrow, but only if that arrow had a performance potential that is at least comparable with a conventional arrow of the same diameter and length.

OBJECTS AND ADVANTAGES

Accordingly several objects and advantages of my invention are;

(1) to provide an arrow which is compactible for storage, carrying, and handling;

(2) to provide an arrow which can be quickly "snapped" together and joined into an extended ready position for shooting with a bow;

(3) to provide a compactible, folding arrow which has a performance that is comparable with or, in some respects is better than a conventional one-piece arrow of the same diameter and length.

Further objects and advantage of my invention will become apparent from a consideration of the drawings and the ensuing description.

Drawing Reference Numerals

Figure 1:
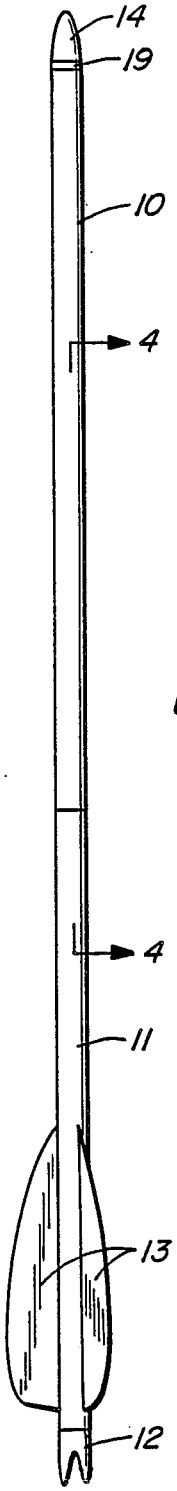
FIG. 1 is a side view of an arrow according to my invention.

10 female front shaft section
11 male rear shaft section
12 nock
13 vanes or fletches
14 tip
15 tubular insert
16 elastic cord
17 retainer disk
18 knot
19 tip insert

DESCRIPTION OF INVENTION

Figure 2:
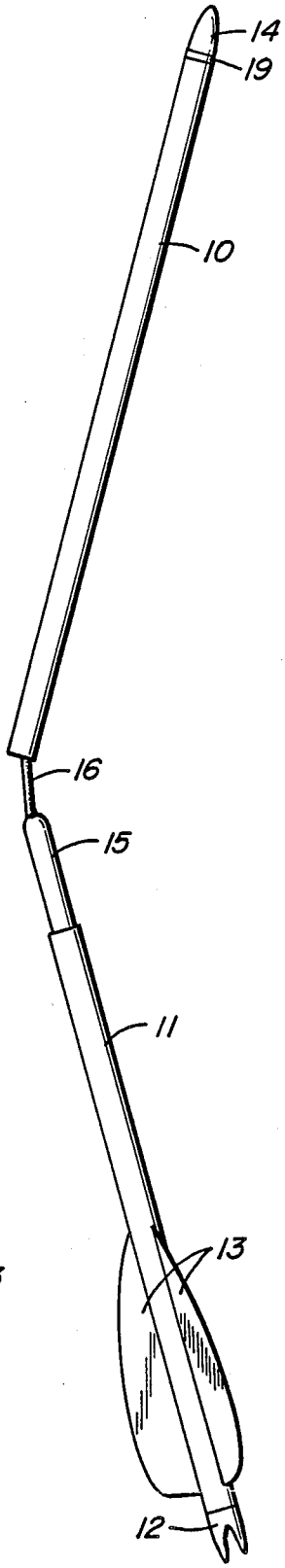
FIG. 2 is a side view of the arrow of FIG. 1 showing the shaft sections separated and in the process of being folded.
Figure 3:
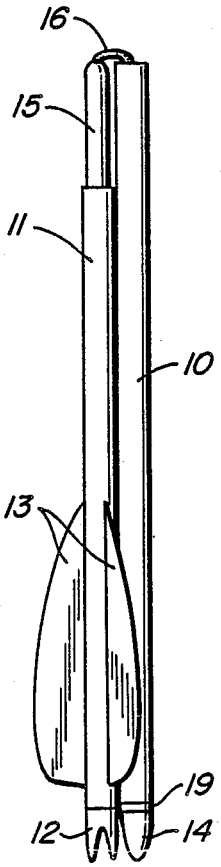
FIG. 3 is a side view of the arrow of FIG. 1 showing the shaft sections separated and fully folded.

FIGS. 1, 2 and 3 show an arrow according to my invention. It has a two-part shaft comprised of a female front shaft section 10 and a male rear shaft section 11.

Sections 10 and 11 are of equal length, each being preferably 12" to 17" long, 0.281" to 0.375" in diameter, and with a wall thickness of from 0.013" to 0.020". Female front shaft section 10 and male rear shaft section 11 can be made of any lightweight strong material, but I prefer an aluminum allow of types 6061-T9, 2024-T8, 7057-T9, or 7178-T9 (Aluminum Association standards).

At the rear end of male rear section 11, a nock 12, and vanes or fletches 13 are affixed.

At the front of female front section 10 (FIGS. 1, 2 and 3) a tip insert 19 is affixed. A tip 14 is threaded into tip insert 19. These parts can be standard, commercially available parts that are most suitable for the use to which the archer wants to put the arrow.

Figure 4:
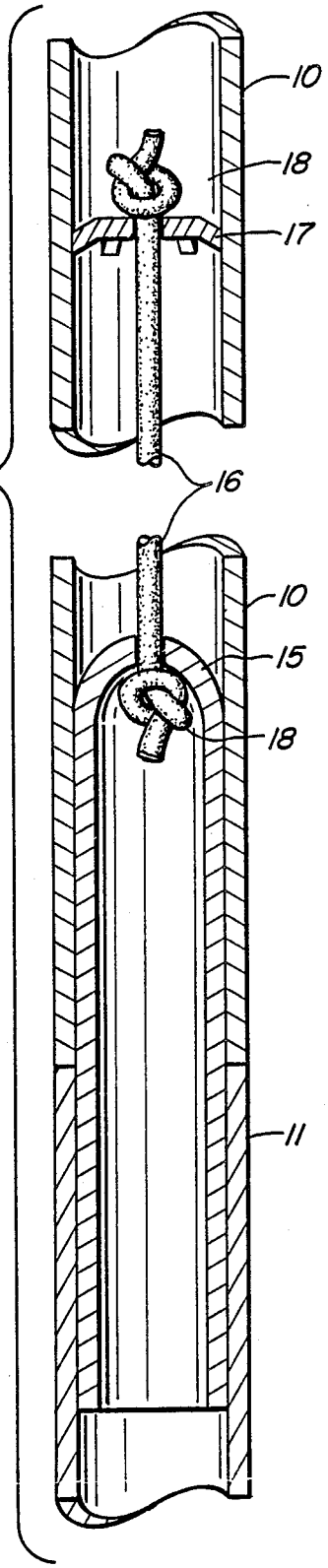
FIG. 4 is an enlarged fractional cross section view of the shaft of my arrow.

As shown in detail in FIG. 4, a tubular insert 19 is affixed by force fit, adhesive, or some other technique into the front of rear section 11, thereby to provide a protruding insert which can mate into the rear of front section 10. Tubular insert 15 acts a slip-joint connector to enable male rear section 11 to mate with the rear end of female front section 10. This slip-joint connector allows the arrow's forward and rearward shaft sections 10 and 11 to be separated and folded. In the folded state as shown in FIG. 3, the arrow is only 13.25" to 18.25" long, whereas in its extended state it is 24" to 34" long.

The forward end of insert 15 is formed into a convex shape. This convex shape serves two purposes: (1) it allows insert 15 to smoothly and rapidly slip into the rear end of section 10; and (2) it acts as a housing to hold a knot 18 at the end of elastic cord 16, as shown in FIG. 4.

The length, wall thickness, and relative position of tubular insert 15 affects the spine, straightness or "trueness", balance point, and separating point of the arrow. Increasing the length and/or wall thickness of insert 15 will increase the arrow's spine. Moving more or less of the length of insert 15 into male section 11 will determine the distance that insert 15 extends into female section 10, and will affect the straightness or "trueness" (lack of wobble) of the arrow. Preferably, insert 15 has a length of 4", with 1.5" of its length affixed within section 11 and 2.5" extending into section 10. Positioning tubular insert 15 forward or rearward relative to the shaft will also shift the shaft's balance point and separating point accordingly. Thus, insert 15 acts a key element in "fine-tuning" or adjusting the performance of my folding arrow.

Elastic cord 16, as shown in FIGS. 2, 3 and 4, is the preferred type of internal elastic device to use in my folding arrow. As shown in detail in FIG. 4, elastic cord 16 interconnects sections 10 and 11 by passing through a hole in the center of the convex forward end of tubular insert 15, on through the inside of section 10 to a retaining disk 17. Cord 16 is under tension and preferably is held in position at both ends by knots 18. This tensioned elastic cord 16 allows sections 10 and 11 to be separated and folded, as shown in FIGS. 2 and 3, and also allows these same shaft sections to be "snapped" or pulled together to form a rigid arrow that is ready to shoot in a bow, as shown in FIG. 1. Cord 16 preferably is made of natural rubber strands encased in double, braided nylon sheaths and is preferably 12" long.

Elastic cord 16 can alternatively be held in position at the rear end of insert 15 by a knot and a washer, or any other retaining device or technique, rather than within the front end of the insert 15 as shown in FIG. 4. However, this arrangement would add to the total weight of the arrow because of the additional length of cord and the weight of the washer or other retaining device. This additional weight would shift the balance point toward the rear end of the arrow. Both the additional weight and the shift of the balance point would adversely affect the arrow's performance.

Retaining disk 17, as shown in FIG. 4, is a spring metal ring with a hole in its center that allows elastic cord 16 to pass therethrough. External teeth around the circumference of ring 17 grip the disk wall of section 10 and hold retaining disk 17 in position. Disk 17 is affixed within section 10 by its being pushed into position by an inserting tool. Other retaining devices or techniques will serve the same purpose. For example, the end of elastic cord 16 could be held in position in a cavity within a special tip insert that would replace standard tip insert 19. However, the retaining disk 17 is preferred because it is very light and can be placed at any position within section 10. Said placement affects the amount and consequent weight of cord 16 and also allows shifting of the balance point of the arrow as required. Thus disk 17 allows further "fine-tuning" or adjusting of the performance of the arrow.

OPERATION OF INVENTION

The folding arrow is normally stored and carried in a fully-folded position as shown in FIG. 3. To ready the arrow for use, the archer need merely hold the rear section in one hand, with the arm extending down. When this hand is moved quickly forward and up, front section 10 will swing away from section 11 and forward (FIG. 2) in an upward arc. The front section will then come into alignment so as to be coaxial with rear section 11. Then elastic cord 16 will snap or pull the two sections together into an extended ready position as shown in FIG. 1. The entire operation is almost instantaneous.

The short length of the folded arrow (FIG. 3) allows it to be easily carried on the archer's body in ways that are more convenient or not possible with a long, conventional, one-piece arrow. For example, the folded arrow can be carried in a quiver strapped to the archer's thigh, whereas a one-piece arrow would be far too long to be conveniently carried in this manner.

The folding arrow of this invention has been target tested by professional archers who have not found any discernable differences in its shooting accuracy when compared with an otherwise similar one-piece arrow.

CONCLUSION AND SCOPE OF INVENTION

The following comparisons point out the advantages of my folding arrow over the prior art telescoping arrow referred to above:

(1) My folding arrow has a straighness or "trueness" that is comparable to a conventional, one-piece arrow because it uses a very close-fitting tubular insert that acts as a slip-joint connector between the front and rear shaft sections. This tubular insert effectively eliminates wobble between these shaft sections. The front shaft section of the telescoping arrow is only supported by external wire fingers.

(2) My folding arrow has a uniform diameter throughout its entire length exactly like a conventional, one-piece arrow. In fact, every aspect of its external shape is exactly like a conventional arrow so that the folding arrow has an aerodynamic capability as effective as that of the conventional arrow. The telescoping arrow has a larger diameter rear shaft section with an abrupt change in diameter to the smaller front shaft section. It also has the exposed wire fingers referred to above.

(3) My folding arrow has its balance point in its front half exactly as does a conventional arrow. The telescoping arrow has its balance point in its rear half.

(4) My folding arrow has only slightly more total weight than a conventional arrow of the same diameter, wall thickness and weight. The telescoping arrow is much heavier than either of the above arrows because of its larger rear shaft section and numerous parts.

(5) My folding arrow has the same ability to pass smoothly over the bow's arrow rest as does the conventional arrow. The telescoping arrow, however, will be deflected by the arrow rest because of its irregular shape.

(6) My folding arrow adds only three simple parts to the already few and simple parts of a conventional arrow. The telescoping arrow is a relatively complex mechanism using numerous parts.

(7) My folding arrow is relatively inexpensive to produce because of its simplicity. The telescoping arrow, with its relative complexity and numerous parts, is far more expensive to produce.

(8) My folding arrow uses the same readily available standard nocks, vanes or fletches, tips, and tip inserts as does the conventional arrow. Most of these parts must be specially made for the telescoping arrow.

The above comparisons show that my folding arrow has the same performance advantages over the telescoping arrow that the conventional arrow has, but it also has important performance advantages over the conventional arrow.

One advantage of my folding arrow is that its tubular insert actually makes the spine of its shaft stiffer than that of the same diameter conventional arrow shaft. For example, a 30" long folding arrow, with a 0.344" diameter and a 0.016" wall thickness, made of 7075-T9 aluminum alloy, and with a 4" long by 0.311" diameter of 0.020" wall, tubular insert, was spine tested at an independent testing facility and compared with an identical one-piece arrow. My folding arrow registered a 0.454" deflection as compared with the one-piece arrow's 0.474" deflection; i.e., it has 4.2% more spine. Another advantage is that the amount of spine of the following arrow's shaft can be increased or decreased by changing the length and/or the wall thickness of the insert. The above advantages mean that a folding arrow can actually have a small diameter shaft and still have the same spine as a conventional arrow with a larger diameter shaft. The folding arrow does have the slight added weight of its tubular insert/elastic cord/retainer ring assembly, 14% in the above example. However, this added assembly weight is offset by the folding arrow's potentially small diameter, and therefore, lighter weight shaft combined with the increased aerodynamic capability of a smaller diameter shaft.

The tubular insert/elastic cord/retainer disk assembly can be positioned within the arrow's shaft to achieve a desired balance point. For example, positioning the assembly towards the front of the shaft will shift the balance point forward. The advantage over a conventional arrow is that this shift of the balance point can be achieved in my folding arrow with no additional weight. In a conventional arrow, if it is desired to shift the balance point forward, a heavier tip is necessitated.

In previous sections of this application, I have described some of my folding arrow's advantages over the conventional arrow due to the folding arrow's easy compactibility, but possibly the most important advantage is that is has allowed me the opportunity to develop a complete compact archery system.

At present, almost all of the better modern bows are of the take-down type. They are made in pieces: two limbs connected by threaded bolts to a center riser. There are various reasons for this type of construction, but compactibility is not usually one of them. Without a compactible arrow, there is no real advantage to a compactible bow. However, by combining a modified take-down bow with my folding arrows, I have developed a complete compact archery system. I have designed and made a fabric pack of the dimensions 5" wide by 20" long by 3.5" thick to house the take-down compound bow, twelve folding arrows, tips, and accessories.

A compact bow/pack system of this size can be carried very easily by hand or as a backpack. It can be carried by bow hunters into brushy or mountainous terrain, where carrying the usual bow and arrows would be very difficult or even dangerous. The bow/-pack can be easily carried by archers on bicycles, motorcycles, horses, etc. It can be conveniently stored under or behind seats in cars, buses, boats, trains, and planes. As can be seen, the bow/pack provides opportunities to carry, store, and use an archery system in ways that are not possible with the usual bows and arrows. This type of complete compact archery system was not possible until I invented the following arrow.

While my above description contains many specificities, these should not be construed as limitations on the scope of the invention, but rather as an exemplification of one preferred embodiment thereof. For example, folding arrows of three or more sections can be made, at a possible sacrifice in size, weight, and ease of use. The male shaft section could be the front section with the female shaft section being the rear section, at a possible disadvantage due to a shift of the balance point of the arrow toward the rear because the elastic cord and the retaining device would have to be in the rear section. The slip-joint connector could be the front portion of the male shaft section if it was swaged or necked down into an insert, but swaging cannot presently be done to as close a tolerance as can drawing an insert tube. A coil spring could be used in place of the elastic cord, but the coil spring would probably increase the arrow's weight. Many other variations are possible and some have been described in the above description. Accordingly, the scope of the invention should not be determined by the embodiment illustrated, but by the appended claims and their legal equivalents.

I claim:

1. An arrow comprising:

(a) a tubular shaft comprised of a front section and a rear section, (b) means enabling said sections to be assembled to form a continuous, substantially rigid shaft and to be disassembled so that said sections can be positioned side by side in an approximately parallel relationship, (c) an elastic cord internal to and connecting said front and rear sections, said cord having each of its ends connected to one of said sections, and being under sufficient tension so as to pull together said sections into a continuous shaft, and (d) a retaining device in the shape of a circumferentially toothed disk for connecting one of the cord ends to its section, said disk being held by press fit against the inner wall of said tubular shaft, said disk having a centrally located hole through which extends said elastic cord.

2. The arrow of claim 1 wherein said rear section is a male section and said front section is a female section.

3. The arrow of claim 2 wherein said male section has a tubular insert affixed internally to and extending from the front end of said male section so as to provide a means to telescopingly join said male section with the rear end of said female section.

4. The arrow of claim 3 wherein the rear end of said elastic cord is held by a knot to said tubular insert and wherein the front end of said elastic cord is held by a knot to said circumferentially toothed disk, said disk being affixed within said female section.

5. The arrow of claim 4 wherein said tubular insert has a front end which is formed into a generally convex shape, said front end having a centrally located hole therethrough.

6. The arrow of claim 4 wherein a nock is affixed to the arrow's rear end, a plurality of vanes or fletches are affixed to the arrow's rear external surface, and a tip insert and tip are affixed to the arrow's front end.

* * * * *